US007739834B2

(12) United States Patent
Stoffels et al.

(10) Patent No.: US 7,739,834 B2
(45) Date of Patent: Jun. 22, 2010

(54) CANTILEVER GATE

(75) Inventors: Richard B. Stoffels, Eden Prairie, MN (US); James G. Sidla, Monticello, MN (US)

(73) Assignee: Garlock Equipment Company, Minneapolis, MN (US)

( * ) Notice: Subject to any disclaimer, the term of this patent is extended or adjusted under 35 U.S.C. 154(b) by 0 days.

(21) Appl. No.: 11/765,268

(22) Filed: Jun. 19, 2007

(65) Prior Publication Data

US 2008/0000156 A1 Jan. 3, 2008

Related U.S. Application Data

(60) Provisional application No. 60/805,141, filed on Jun. 19, 2006.

(51) Int. Cl.
*E01F 13/00* (2006.01)

(52) U.S. Cl. ..... 49/49; 49/233; 49/50

(58) Field of Classification Search ..... 49/49, 49/226, 232, 233, 50, 234, 339, 394, 131; 404/9, 11

See application file for complete search history.

(56) References Cited

U.S. PATENT DOCUMENTS

| | | | | | |
|---|---|---|---|---|---|
| 669,208 | A * | 3/1901 | Simon | 49/385 |
| 964,545 | A * | 7/1910 | Perritt | 49/233 |
| 2,563,894 | A * | 8/1951 | White | 49/226 |
| 3,061,960 | A * | 11/1962 | Dull | 49/35 |
| 4,122,629 | A | 10/1978 | Rennick | 49/357 |
| 4,438,596 | A | 3/1984 | Jones et al. | 49/463 |
| 4,576,541 | A * | 3/1986 | Dunn et al. | 414/545 |
| 4,620,393 | A * | 11/1986 | Stafset | 49/394 |
| 4,658,543 | A * | 4/1987 | Carr | 49/139 |
| 5,271,183 | A | 12/1993 | Hahn et al. | 49/360 |
| 5,299,386 | A | 4/1994 | Naegelli et al. | 49/28 |
| 5,343,583 | A | 9/1994 | Cook | 14/71.3 |
| 5,459,963 | A | 10/1995 | Alexander | 49/34 |
| 5,564,238 | A | 10/1996 | Ellis | 52/173.2 |
| 5,649,396 | A | 7/1997 | Carr | 52/174 |
| 5,984,569 | A * | 11/1999 | Chou | 404/6 |
| 6,119,399 | A * | 9/2000 | McCain et al. | 49/340 |
| 6,186,274 | B1 | 2/2001 | Reynolds et al. | 182/138 |
| 6,611,992 | B1 * | 9/2003 | Arnaud | 16/239 |
| 6,796,084 | B2 * | 9/2004 | Gagnon | 49/226 |
| 6,935,000 | B1 * | 8/2005 | Arnaud | 16/239 |
| 2004/0261319 | A1 * | 12/2004 | Kennedy et al. | 49/339 |
| 2005/0177988 | A1 * | 8/2005 | Williams | 29/252 |

OTHER PUBLICATIONS

Guardrite® Ex 3 Barrier System brochure of Rite-Hite Aftermarket Corporation, Milwaukee, WI 53224-9520 (unknown date, but at least 2006).

* cited by examiner

*Primary Examiner*—Gregory J. Strimbu
(74) *Attorney, Agent, or Firm*—Alan Kamrath; Kamrath & Associates PA

(57) ABSTRACT

Cantilever gates (10) in the form of parallelograms include first and second bars (40) and a toe board (140) extending between and pivotally mounted to first and second posts (20, 30) and moveable between closed and open positions. Gas struts (46) assist in moving the gate (10). A lock (60) in the form of a pivotal latch (62) holds the gate (10) in its open position. A slide receptor (80) slideably receives the second post (30) as the gate (10) moves from the open to the closed position and can be removably secured to the support surface mounting plate (82). A pair of cantilever gates (10) can have their respective second posts (30) slideably related.

15 Claims, 8 Drawing Sheets

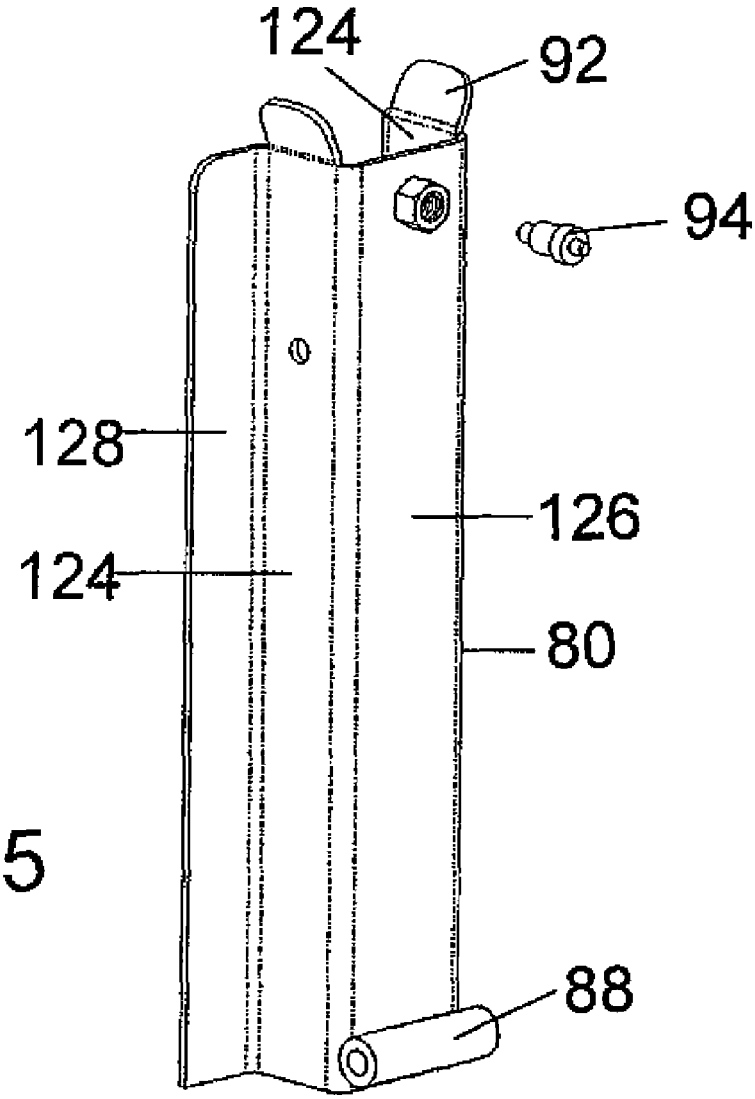
Fig. 5
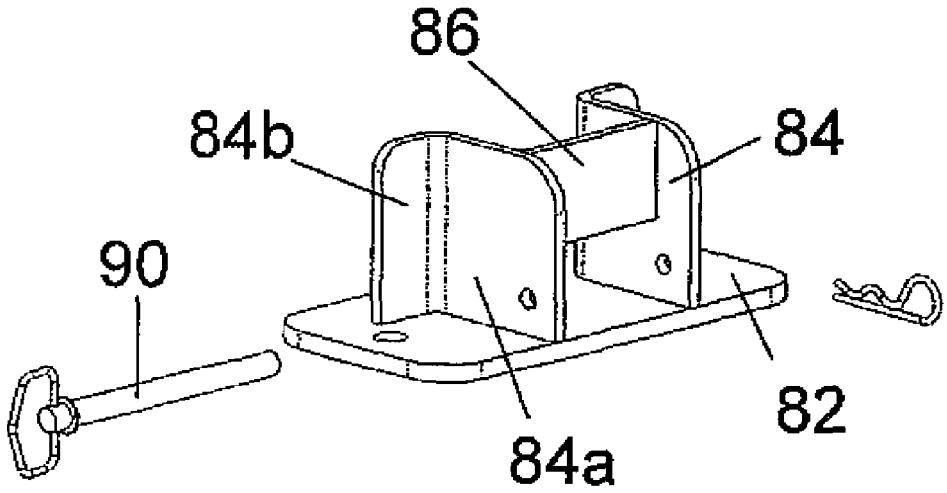

CANTILEVER GATE

BACKGROUND

The present invention generally relates to removable safety systems for doorways and the like and, in preferred aspects, to cantilever gates.

A safety concern exists for loading docks as persons can accidentally or unintentionally go over an edge of the loading dock when a truck is not abutting therewith. Thus, gates are often positioned across doorways which can be closed while a truck is moving relative to or is not abutting with the loading dock. Conventional gates are often slideably mounted. However, if several loading docks are present, such sliding gates often interfere with adjacent docks. Cantilever gates have also been proposed but have not achieved significant market success due to various deficiencies.

Thus, a need exists for a cantilever gate which overcomes the deficiencies of prior gates.

SUMMARY

The present invention solves this need and other problems in the field of safety rails by providing, in a first aspect, a novel cantilever gate.

In another aspect of the present invention, a novel cantilever gate includes a lock which automatically locks when the cantilever gate is moved to its open position.

In still a further aspect of the present invention, a novel cantilever gate is advantageous in resisting torsional forces placed on the gate in the closed position.

In still another aspect of the present invention, a novel cantilever gate automatically locks when the cantilever gate is moved to its closed position.

In other aspects of the present invention, a novel cantilever gate requires reduced headroom.

In other aspects of the present invention, a novel cantilever gate includes a toe board.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where:

FIG. 5 shows a partial, exploded, perspective view of the cantilever gate of FIG. 1.

Figure 1:
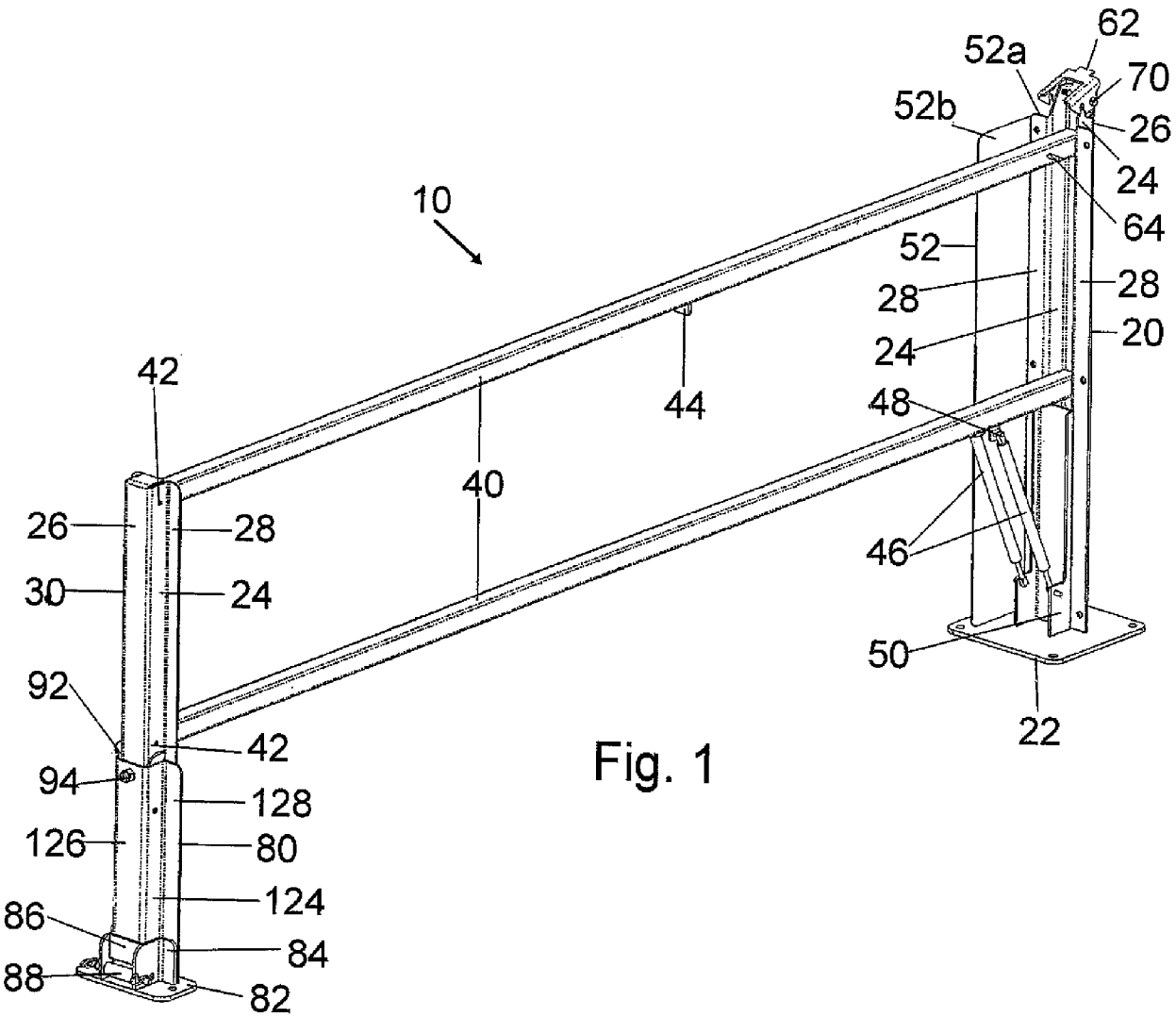
FIG. 1 shows a perspective view of a cantilever gate according to the preferred teachings of the present invention in a closed position.
Figure 2:
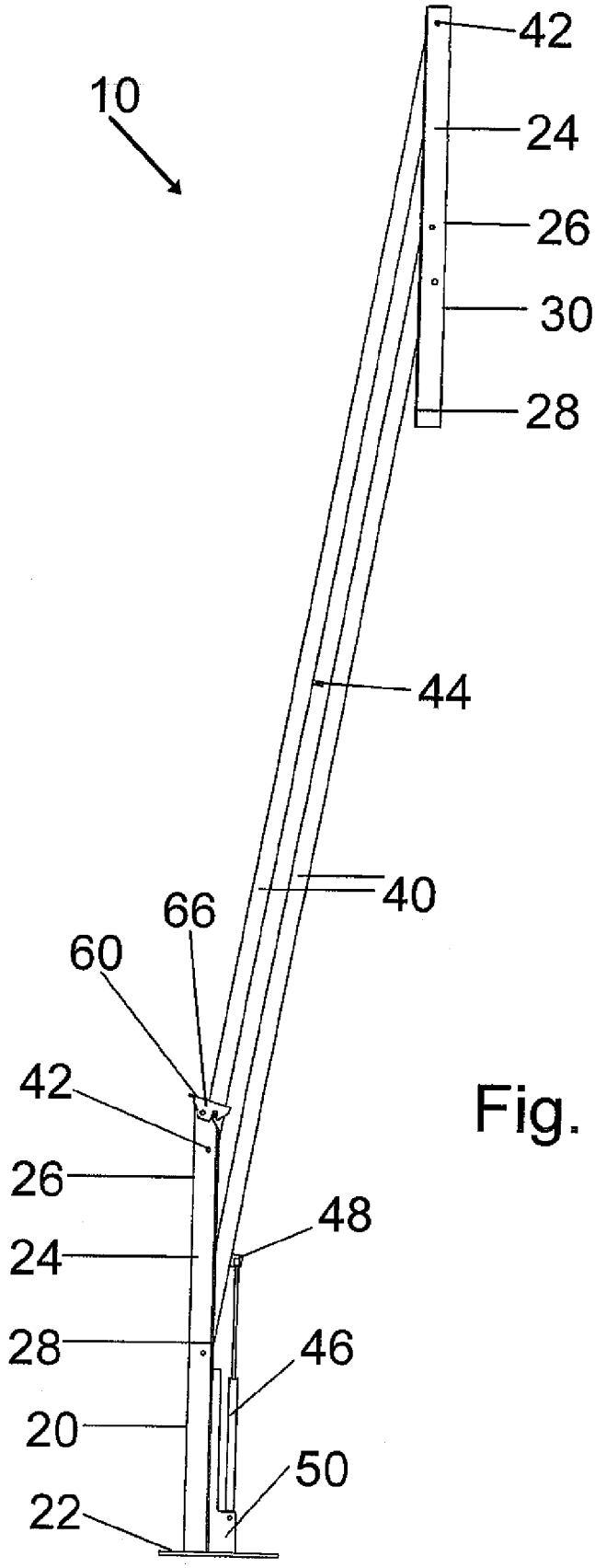
FIG. 2 shows a partial perspective view of the cantilever gate of FIG. 1 in an open position.
Figure 3:
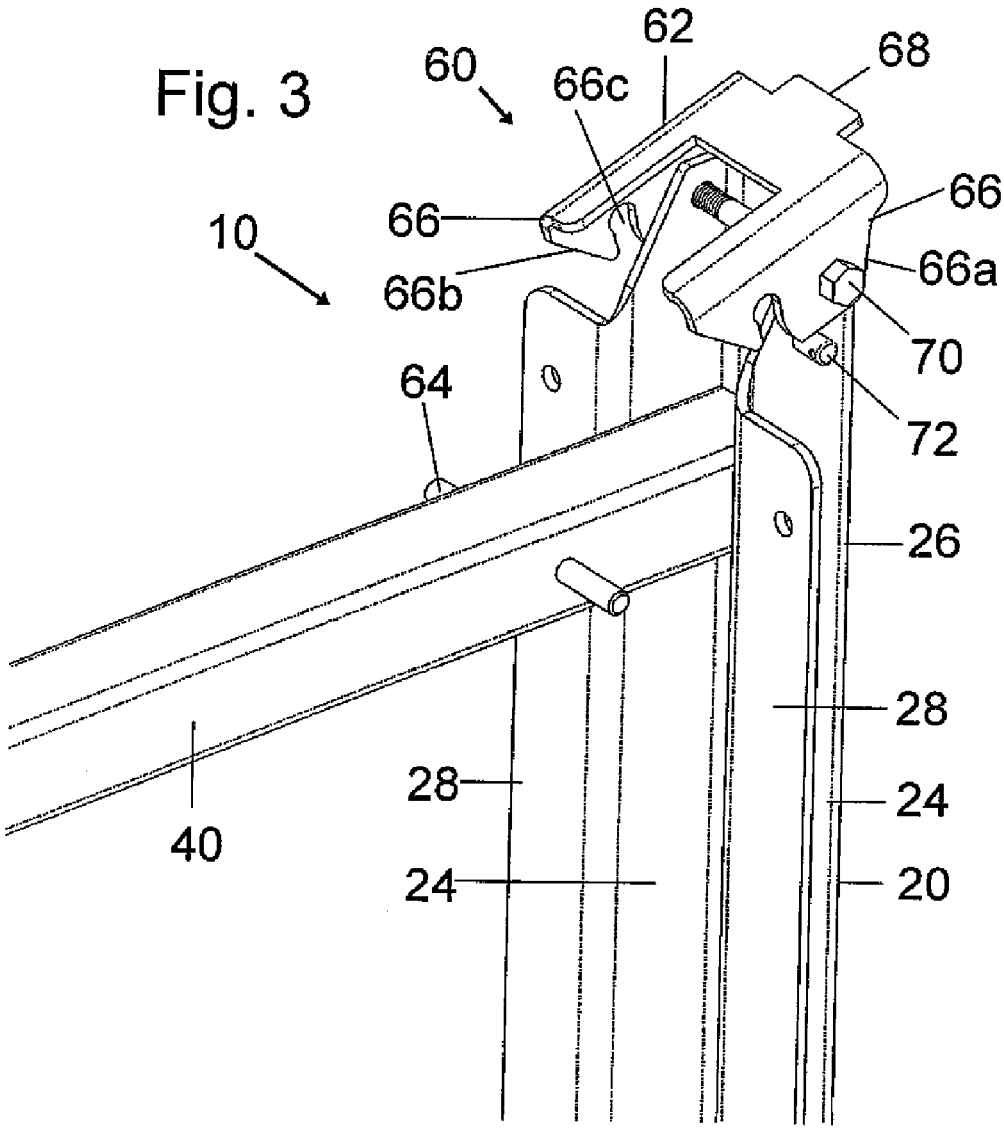
FIG. 3 shows a partial perspective view of the cantilever gate of FIG. 1 in a closed position.
Figure 4:
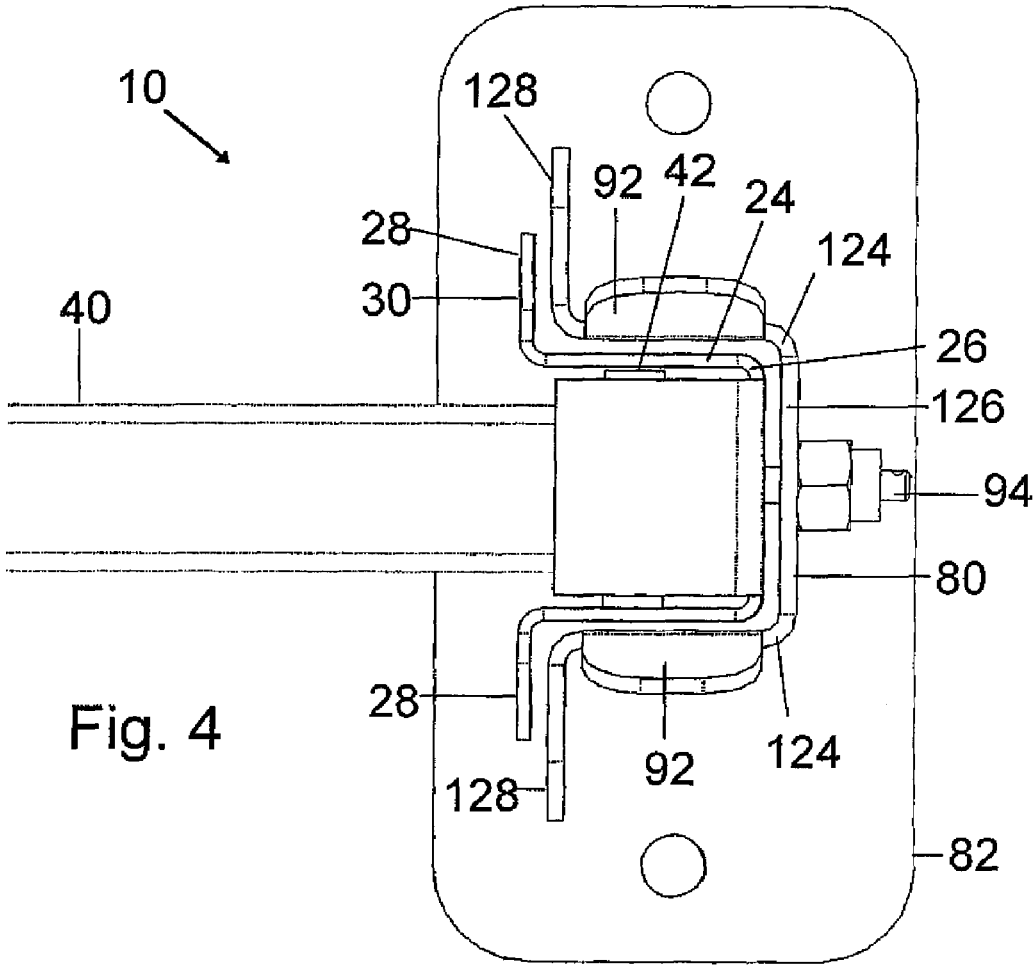
FIG. 4 shows a partial top view of the cantilever gate of FIG. 1.
Figure 6:
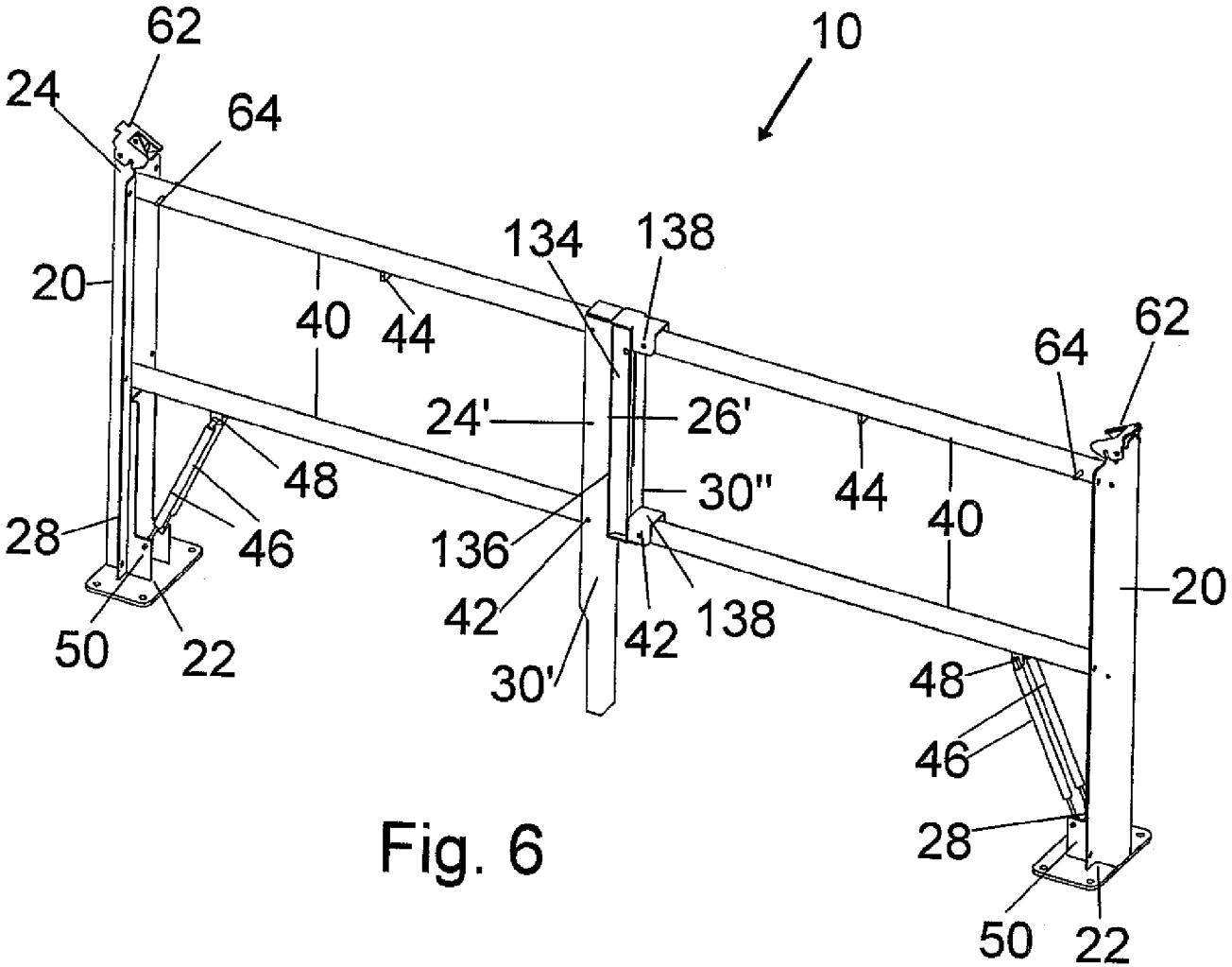
FIG. 6 shows a perspective view of an alternate embodiment of a cantilever gate according to the preferred teachings of the present invention in a closed position.
Figure 7:
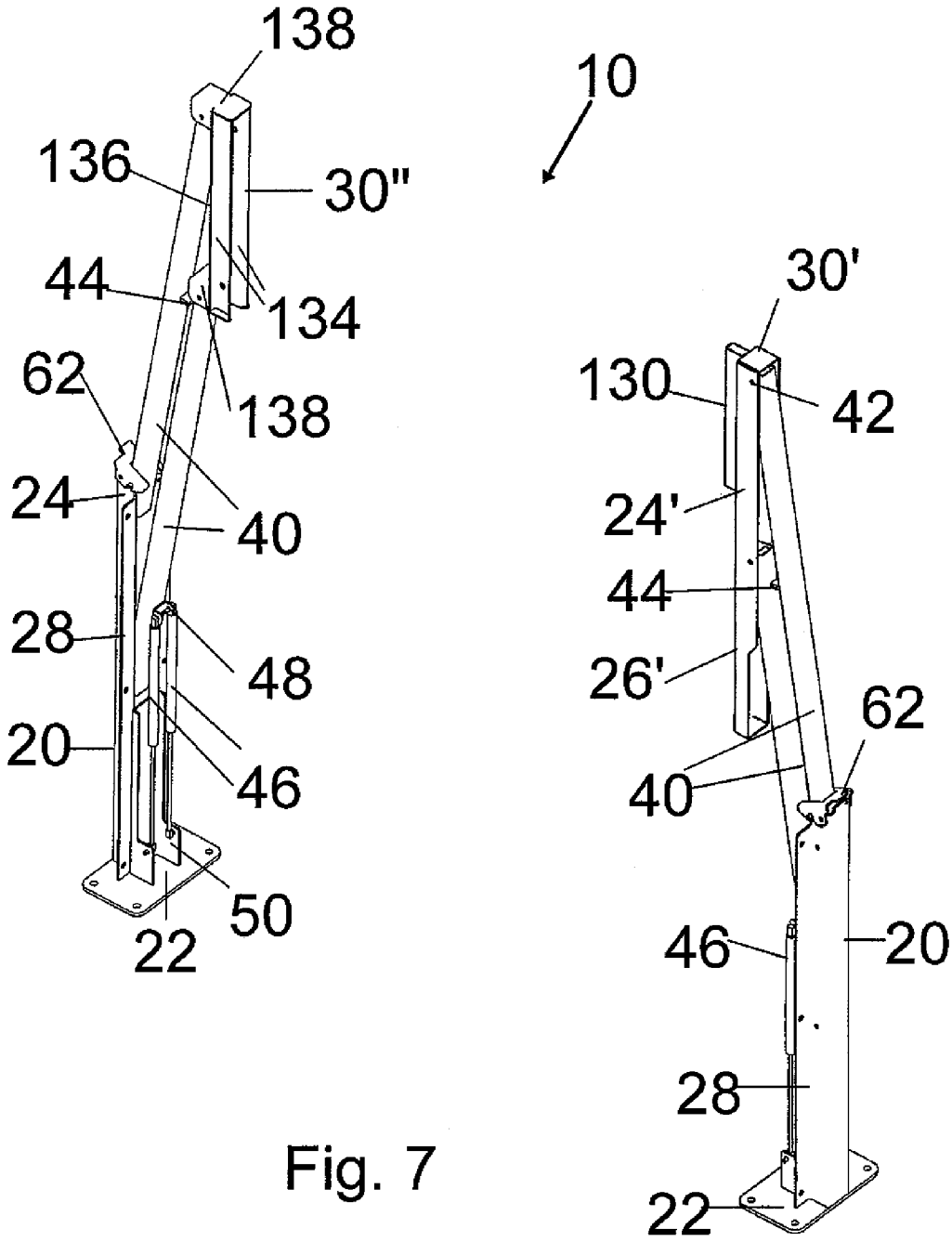
FIG. 7 shows a perspective view of the cantilever gate of FIG. 6 in an open position.
Figure 9:
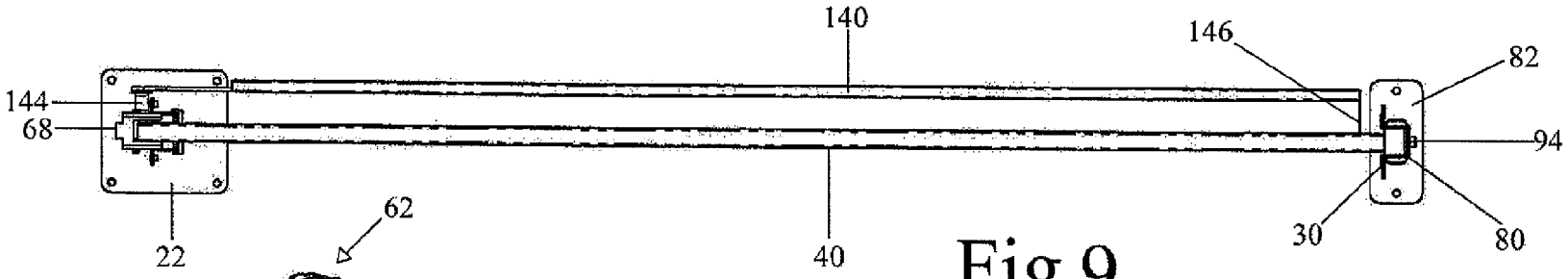
FIG. 9 shows a top view of the cantilever gate of FIG. 8.
Figure 8:
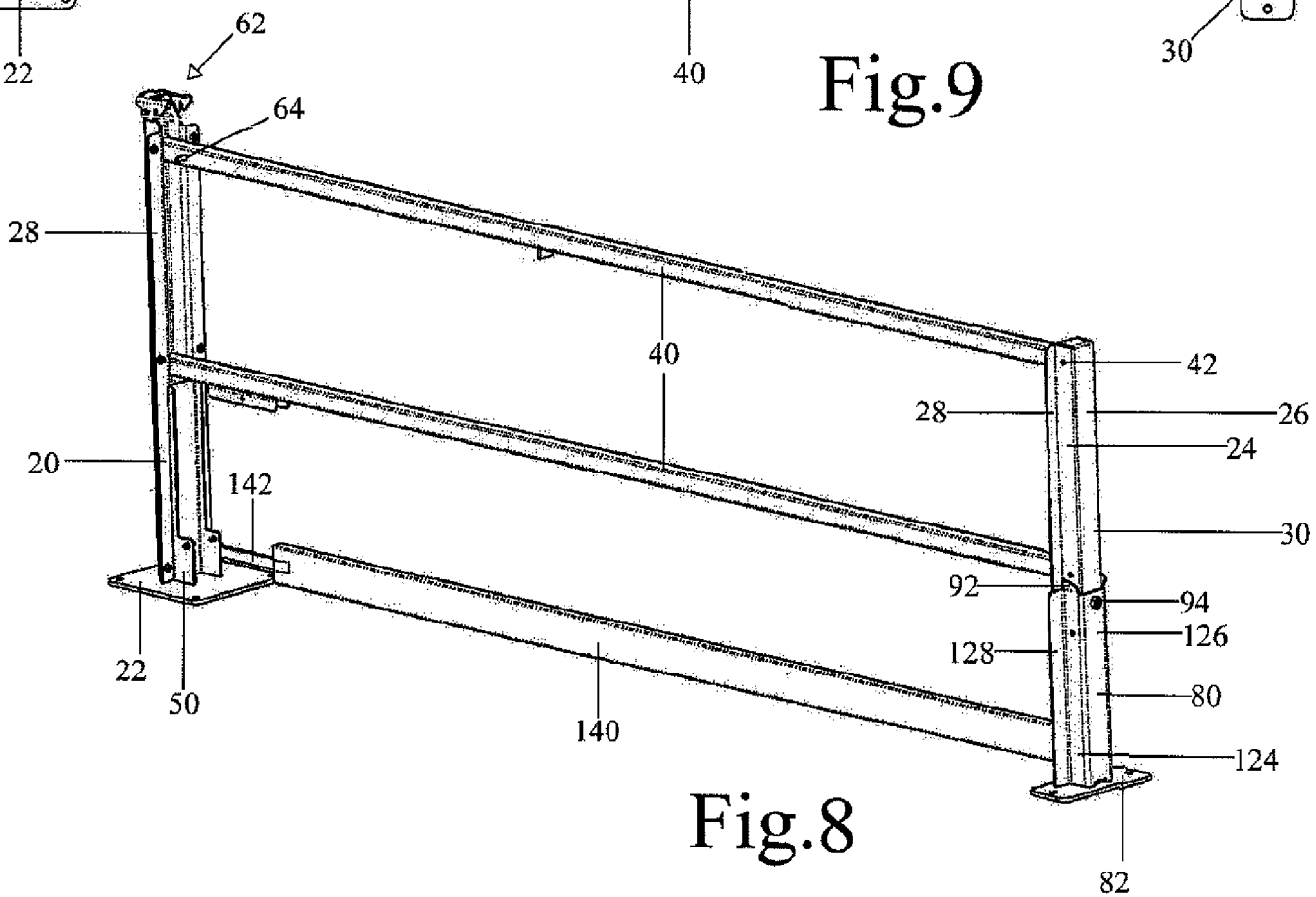
FIG. 8 shows a perspective view of an alternate embodiment of a cantilever gate according to the preferred teachings of the present invention in a closed position.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "width", "length", "end", "side", "horizontal", "vertical", "radial", and similar terms are used herein, it should be understood that these terms have reference only to the structure shown in the drawings as it would appear to a person viewing the drawings and are utilized only to facilitate describing the illustrative embodiments.

DESCRIPTION OF THE PREFERRED EMBODIMENTS

A cantilever gate according to the preferred teachings of the present invention is shown in the drawings and generally designated 10. Generally, gate 10 includes first and second vertical posts 20 and 30 extending vertically from a horizontal support surface In the preferred form shown, post 20 is fixed to the support surface such as being permanently secured to a mounting plate 22 in turn permanently secured to the support surface such as by bolts or the like. In the preferred form, post 20 extends generally perpendicular to plate 22. However, it can be appreciated that post 20 can be suitably fixed relative to the support surface in any desired manner.

Each post 20 and 30 in the most preferred form shown is generally in the shape of an Ω (omega) and includes the outer edges of first and second legs 24 integrally connected generally perpendicular to an interconnection plate 26. The inner edges of first and second legs 24 are integrally connected to outwardly projecting wings 28 extending generally perpendicular to legs 24 and parallel to but spaced from plate 26. Posts 20 and 30 in the preferred form are formed of stock material which is cut and drilled into its final configuration. However, it can be appreciated that posts 20 and 30 can be of any desired shape and configuration according to the teachings of the present invention.

Gate 10 in the most preferred form is a parallelogram and generally includes first and second bars 40 extending between and pivotally mounted to posts 20 and 30. In the most preferred form shown, bars 40 are tubular having square cross sections of a width generally equal to but slideably received between legs 24 of posts 20 and 30. Bars 40 are pivotably mounted about pivot axes to posts 20 and 30 such as by bolts 42 extending through legs 24 of posts 20 and 30 and bars 40, with the pivot axes of bars 40 and post 20 being spaced generally equal to the spacing of the pivot axes of bars 40 and post 30. It can be appreciated that bars 40 and the manner of pivotal attachment to posts 20 and 30 can be of any desired shape and configuration according to the teachings of the present invention.

It can be appreciated that gate 10 is moveable between a closed position and an open position. Specifically, in the closed position, the lower end of post 30 engages the horizontal support surface, with bars 40 being in a generally horizontal, parallel spaced relation, and with posts 20 and 30 being at their greatest horizontal spacing. It can be appreciated that a force can be placed upon bars 40 to pivot them relative to post 20 such that the vertical spacing of post 30 from the support surface increases and the horizontal spacing of post 30 from post 20 decreases. Specifically, in the open position of gate 10, bars 40 can be pivoted to a generally abutting position extending at an obtuse angle upwardly from post 20. In the most preferred form, a spacer 44 is provided on the upper bar 40 intermediate posts 20 and 30 and for abutting with lower bar 40 when gate 10 is in the open position. Spacer 44 is provided as a safety measure to prevent bars 40 from completely abutting with each other and in particular are at a spacing to prevent pinching fingers or other element therebetween.

In the preferred form, posts 20 and 30 and bars 40 are formed of metal and represent significant mass. Thus, suitable provisions should be provided for moving gate 10 between the open and closed positions. In the preferred form shown, gate 10 is moved manually without the use of outside power. In the preferred form, provisions can be provided for assisting in moving gate 10 from its closed position to its open position against the force of gravity and/or for resisting moving gate 10 from its open position to its closed position under the force of gravity. In the form shown, gas struts 46 have upper ends pivotally mounted to tabs 48 fixed to the lower bar 40 and lower ends pivotably mounted in a bracket 50 fixed to post 20. In the preferred form shown, bracket 50 has generally U-shaped cross sections of a size and shape for receipt in and between legs 24 of post 20.

According to the preferred teachings of the present invention, a guard 52 is secured to post 20 and has an extent to cover gas struts 46 when gate 10 is in its open position. In the most preferred form, guard 52 is L-shaped and includes a first plate 52*a* abutting against and secured to wing 28 of one of legs 24. Guard 52 further includes a second plate 52*b* integrally extending generally perpendicular to plate 52*a* and generally parallel to but spaced outwardly from leg 24. In the preferred form, guard 52 has a height generally equal to but slightly shorter than post 20 and has L-shaped cross sections throughout its height.

According to the most preferred teachings of the present invention, gate I 0 includes a lock 60 for holding gate 10 in its open position. In the preferred form shown, lock 60 generally includes a latch 62 pivotably mounted to post 20 for releasably engaging with a pin 64 extending through the upper bar 40 in a spaced parallel relation to the pivot axes of bars 40 to posts 20 and 30. Latch 62 has generally U-shaped cross sections having first and second catches 66 extending downwardly from a goal post-shaped handle 68. In particular, catches 66 include a trailing portion 66*a* having a lower edge spaced from handle 68 and in the most preferred form parallel thereto. Latch 62 is pivotably mounted to the top of post 20 such as by a bolt 70 extending through trailing portions 66*a* of latch 62 and legs 24 of post 20 and extending parallel to but spaced from the pivot axes of bars 40 and post 20. Catches 66 further include a leading portion 66*b* having a lower edge extending at an acute angle in the order of 45° from handle 68 towards trailing portion 66*a*. Portions 66*a* and 66*b* are separated by an arcuate slot 66*c* having a radius from the pivot axis of latch 62. In the most preferred form, lock 60 further includes an abutment 72 extending from post 20 spaced from the pivot axis of latch 62 and forming a stop for limiting the movement of latch 62 relative to the post 20 when not engaged with pin 64.

In operation and assuming that gate 10 is in its closed position and is moving towards its open position, bars 40 will pivot relative to post 20 and latch 62 until pin 64 engages with the inclined lower edge of portion 66*b*, with abutment 72 holding latch 62 in a position to ensure that pin 64 engages the inclined lower edge. The inclined lower edge of portion 66*b* will cam upon and pivot latch 62 with further pivoting of gate 10 until pin 64 aligns with slot 66*c*. When aligned, latch 62 will pivot downwardly under gravitational forces to insert pin 64 in slots 66*c* and thereby latch gate 10 in its open position. Thus, latch 62 can latch gate 10 automatically simply by moving gate 10 to its open position and specifically without having to actuate lock 60. To unlatch, handle 68 can be pushed to move slots 66*c* away from pin 64 and thereby allow relative movement of pin 64 and latch 62.

Due to the length of bars 40, torsional forces can be placed upon post 20 about a vertical axis. To counteract such torsional forces, gate 10 includes a slide receptor 80 for slideably receiving post 30 in both vertical and horizontal directions. In the preferred form shown, receptor 80 has a shape corresponding to and for slideably receipt of post 30. Specifically, in the preferred form shown, receptor 80 is generally in the shape of an Ω and includes the outer edges of first and second legs 124 integrally connected generally perpendicular to an interconnection plate 126. The inner edges of first and second legs 124 are integrally connected to outwardly projecting wings 128 extending generally perpendicular to legs 124 and parallel to but spaced from plate 126. The spacing of legs 124 is generally equal to but slightly greater than and for slideable receipt of legs 24 of post 30. Further, the relative width of legs 24 and 124 allow plates 26 and 126 and wings 28 and 128 to abut when post 30 is received in receptor 80.

Receptor 80 is suitably fixed relative to the horizontal support surface. In a preferred form, a mounting plate 82 is suitably fixed to the horizontal support surface and which, in turn, is permanently secured to the support surface such as by bolts or the like. In one preferred form, receptor 80 can be directly permanently secured to mounting plate 82. In other preferred forms, receptor 80 is removably secured to mounting plate 82. In a preferred form shown, first and second L-shaped lugs 84 are secured to mounting plate 82 having first legs 84*a* in a spaced relation for slideable receipt of legs 124 of receptor 80. Lugs 84 further include second legs 84*b* for abutting with wings 128. A joist 86 extends perpendicularly between legs 84*a* and perpendicular to but spaced from mounting plate 82 and for abutting with plate 126. A tube 88 is secured to plate 126 at the lower end of receptor 80. A pin 90 extends through apertures formed in legs 84 behind joist 86 and through tube 88. Due to the receipt of pin 90 and the abutment of wings 28 and 128, legs 24 and 124 and plates 26 and 126, receptor 80 is rigidly held relative to the support surface. In the preferred form shown, the upper ends of legs 124 include angled guides 92 for guiding posts 30 into receptor 80.

It can be appreciated that gate 10 is prevented from pivoting beyond its closed position by the abutment of post 30 upon the support surface. Likewise, the slideable receipt of post 30 within receptor 80 resists horizontal forces upon gate 10. In some applications, it is desired to prevent unintentional or undesired movement of gate 10 from its closed position. In the preferred form of the present invention, a slide spring pin 94 is mounted to plate 126 adjacent to the upper end of receptor 80 and is normally biased to extend inwardly of plate 126. Likewise, apertures can be provided in receptor 80 and post 30 to removably receive a suitable lock mechanism such as a padlock.

Now that the basic construction of cantilever gate 10 according to the preferred teachings of the present invention has been set forth, a method of operation can be explained, and some of the advantages obtained thereby highlighted. In particular and for the sake of explanation, it will be assumed that gate 10 is in its closed position and is extending across a doorway or the like such as a doorway to a loading dock. In the closed position, gate 10 generally acts as a safety barricade for preventing people from accidentally or unintentionally passing through the doorway and off an elevated dock or the like.

When it is desired to provide access through the doorway (such as after a truck trailer is abutting with the elevated dock), it is desired to move gate 10 to its open position. Initially, slide spring pin 94 is pulled and moved from its locked position to its unlocked position. While in the unlocked position, a user can place an upward force upon bars 40 to pivot bars 40 relative to post 20, with post 30 moving in vertical and horizontal directions relative to receptor 80. Pivotal movement of bars 40 is assisted by gas struts 46 in the preferred form shown. Bars 40 can be pivoted relative to post 20 until pin 64 engages and is hooked by latch 62. At that time, bars 40 and gate 10 are held in the open position which in the preferred form provides a relatively unobstructed access to the doorway in front of which gate 10 is located. Additionally, if desired and in the form shown, receptor 80 can be removed from mounting plate 82 after removing pin 90 therefrom When it is desired to block access to the doorway such as after the truck trailer has been loaded, handle 68 is pushed to pivot latch 62 relative to post 20 to remove pin 64 from slot 66*c*. While handle 68 is being held, bars 40 can be pivoted relative to post 20 from the open position to the closed position. Pivotal movement of bars 40 is resisted by gas struts 46 in the preferred form shown. Post 30 will slide vertically and horizontally into receptor 80 (which could have been secured to mounting plate 82 if previously removed therefrom). Slide spring pin 94 will slide upon interconnection plate 26 until aligned with the aperture therein at which time slide spring pin 94 will move under bias into its locked position. Thus, gate 10 will be locked in its closed position.

It can be appreciated that the height of gate 10 in its open position is directly related to the length of bars 40 which is then directly related to the width of gate 10 in its closed position. Especially for gates 10 of large widths and as gates 10 are typically positioned inside of buildings, insufficient headroom may be present. In such applications, a pair of cantilever gates 10 is provided. In the form shown, post 30' of one of gates 10 has generally U-shaped cross sections having first and second legs 24' extending between an interconnection plate 26'. An elongated protrusion 130 extends from plate 26' opposite to legs 24' and generally parallel to legs 24'. Post 30" of the other gate 10 has generally U-shaped cross sections having first and second legs 134 extending between an interconnection plate 136. The spacing of legs 134 is generally equal to but slightly greater than and for slideable receipt of protrusion 130. Post 30" further includes pivot mounts 138 extending from plate 136 opposite to legs 134 and to which bars 40 are pivotably mounted. In the preferred form, post 30" has a height generally equal to the spacing between the pivot axes of bars 40 to post 30". However, it can be appreciated that post 30" according to the teachings of the present invention could have a height which contacts the support surface if desired. It should also be appreciated that suitable provisions such as spring pin 94 can be provided for locking posts 30' and 30" together if desired.

Operation of the pair of gates 10 is identical to a single gate 10 according to the teachings of the present invention except that protrusion 130 is horizontally and vertically received in post 30" rather than post 30 horizontally and vertically slideably received in receptor 80. Thus, a person skilled in the art should be able to appreciate operation and advantages of the pair of gates 10 according to the teachings of the present invention.

In the most preferred form, gate 10 can include a toe board 140 which generally abuts with the support surface in a plane parallel to but spaced from the plane including bars 40. In the preferred form shown, toe board 140 includes a straight extension 142 extending therefrom. A pivot shaft 144 extends from post 20 in a spaced parallel relation to bolts 42 at a location adjacent to the support surface. In the most preferred form, pivot shaft 144 is attached to post 20 via a bracket so that its provision is optional as well as to allow retrofitting to previously existing gates 10 not previously including toe board 140. Extension 142 is secured to pivot shaft 144 for allowing pivotal movement between post 20 and toe board 140. Toe board 140 further includes an L-shaped extension 146 extending from an end opposite to extension 142. Specifically, in the form shown, the first leg of extension 146 extends generally perpendicularly to toe board 140 and the second leg of extension 146 extends in the plane including bars 40. The second leg of extension 146 is pivotally connected to post 30. Thus, toe board 140, first and second bars 40, and posts 20 and 30 define parallelograms.

Now that the basic teachings of the present invention have been explained, many extensions and variations will be obvious to one having ordinary skill in the art. For example, although embodiments have been shown and described including a combination of several inventive aspects and are believed to present synergistic results, such inventive aspects can have application singularly and/or in other combinations according to the teachings of the present invention. As an example but not limited thereto, removably secured receptor 80 could be utilized with power assisted gate moving provisions which could also lock the gate 10 in desired positions.

Thus since the invention disclosed herein may be embodied in other specific forms without departing from the spirit or general characteristics thereof some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A cantilever gate comprising, in combination: a first post fixed to a support surface; a second post; first and second bars extending between and pivotally mounted to the first and second posts to define a parallelogram movable between a closed position and an open position, with the bars being generally parallel to the support surface in the closed position and at an acute angle to the support surface in the open position; and a slide receptor for slideably receiving the second post therein when the parallelogram is in the closed position, wherein the second post has a lower end contacting the support surface in the closed position of the parallelogram and with the slide receptor slideably receiving a portion of the second post which is spaced from the lower end of the second post when the parallelogram is in the closed position, wherein each of the first and second bars terminate in first and second ends, with the first ends of the first and second bars pivotally mounted to the first post and with the second ends of the first and second bars pivotally mounted to the second post, wherein the second post and the slide receptor each includes first and second legs integrally connected to an interconnection plate, with the second ends of the first and second bars located intermediate the first and second legs of the second post, with the first and second legs of the second post located intermediate the first and second legs of the slide receptor when the parallelogram is in the closed position.

2. The cantilever gate of claim 1 further comprising, in combination: a slide spring pin mounted to the slide receptor, with the slide spring pin being engageable with the second post, with the slide spring pin being mounted to the interconnection plate of the slide receptor.

3. The cantilever gate of claim 1 wherein the slide receptor is fixed to the support surface.

4. The cantilever gate of claim 1 further comprising, in combination: a mounting plate fixed to the support surface, with the mounting plate having first and second lugs slideably receiving the first and second legs of the slide receptor, with the first and second legs of the slide receptor being intermediate the first and second lugs of the mounting plate, with the mounting plate further having a joist extending between the first and second lugs and abutting with the interconnection plate of the slide receptor; a tube secured to the interconnection plate of the slide receptor; and a pin extending through the first and second lugs and the tube.

5. The cantilever gate of claim 4 wherein the slide receptor further includes wings projecting outwardly from the first and second legs of the slide receptor, with the first and second lugs each including a leg abutting with a respective one of the wings.

6. The cantilever gate of claim 1 further comprising, in combination: a latch pivotally mounted to the first post; and a pin extending from the first bar, wherein the latch engages with the pin when the parallelogram is in the open position and the latch is spaced from the pin when the parallelogram is in the closed position.

7. A cantilever gate comprising, in combination: a first post fixed to a support surface; a second post; first and second bars extending between and pivotally mounted to the first and second posts to define a parallelogram movable between a closed position and an open position, with the bars being generally parallel to the support surface in the closed position and at an acute angle to the support surface in the open position; a slide receptor for slideably receiving the second post therein when the parallelogram is in the closed position; a mounting plate fixed to the support surface, with the mounting plate having first and second lugs slideably receiving the slide receptor, with the slide receptor being intermediate the first and second lugs of the mounting plate, with the mounting plate further having a joist extending between the first and second lugs and abutting with the slide receptor; a tube secured to the slide receptor; and a pin extending through the first and second lugs and the tube.

8. The cantilever gate of claim 7 wherein the second post has a lower end contacting the support surface when the parallelogram is in the closed position, and with the slide receptor slideably receiving a portion of the second post which is spaced from the lower end of the second post when the parallelogram is in the closed position.

9. The cantilever gate of claim 8 wherein each of the first and second bars terminate in first and second ends, with the first ends of the first and second bars pivotally mounted to the first post and with the second ends of the first and second bars pivotally mounted to the second post.

10. The cantilever gate of claim 9 further comprising, in combination: a spacer provided on the first bar and spaced from the first and second posts, with the spacer being spaced from the second bar when the parallelogram is in the closed position and abutting with the second bar when the parallelogram is in the open position to prevent the first and second bars from abutting.

11. The cantilever gate of claim 9 further comprising, in combination: a gas strut having a first end pivotally mounted to the first bar and a second end pivotally mounted to the first post, with the gas strut assisting movement of the parallelogram from the closed position to the open position.

12. The cantilever gate of claim 11 further comprising, in combination: a guard having an L-shape and including a first plate secured to the first post and a second plate extending generally perpendicular to the first plate, with the second plate covering the gas strut when the parallelogram is in the open position.

13. The cantilever gate of claim 9 further comprising, in combination: a latch pivotally mounted to the first post; and a pin extending from the first bar, with the latch engaged with the pin when the parallelogram is in the open position, with the latch spaced from the pin when the parallelogram is in the closed position.

14. The cantilever gate of claim 13 wherein the latch is pivotally mounted to the first post about a pivot axis, with the latch including an arcuate slot, with the pin having a longitudinal axis being parallel to and spaced from the pivot axis, with the pin insertable into the arcuate slot, with the latch further including a lower edge, with the lower edge of the latch caroming on the pin as the parallelogram moves into the open position.

15. The cantilever gate of claim 9 further comprising, in combination: a toe board having a first end pivotally mounted to the first post and a second end pivotally mounted to the second post, with the toe board being adjacent to the support surface when the parallelogram is in the closed position.

* * * * *

UNITED STATES PATENT AND TRADEMARK OFFICE

CERTIFICATE OF CORRECTION

PATENT NO. : 7,739,834 B2
APPLICATION NO. : 11/765268
DATED : June 22, 2010
INVENTOR(S) : Stoffels et al.

It is certified that error appears in the above-identified patent and that said Letters Patent is hereby corrected as shown below:

Column 2, line 28, cancel "surface" and substitute therefore --surface.--.

Column 6, line 34, cancel "thereof" and substitute therefore --thereof,--.

Column 6, line 50, cancel "for".

Column 7, line 23, after "wings" insert --of the slide receptor--.

Column 7, line 37, cancel "for".

Column 8, line 40, cancel "caroming" and substitute therefore --camming--.

Signed and Sealed this
Eleventh Day of January, 2011

David J. Kappos

David J. Kappos
*Director of the United States Patent and Trademark Office*